US005536197A

United States Patent [19]

Barozzi

[11] Patent Number: 5,536,197

[45] Date of Patent: Jul. 16, 1996

[54] AUTOMATIC MACHINE FOR THE PRODUCTION OF ROUNDED BEVELS AT THE CORNERS OF FLAT SHEETS

[75] Inventor: Gian P. Barozzi, Crema, Italy

[73] Assignee: AISA S.p.A., Cumignano, Italy

[21] Appl. No.: 303,469

[22] Filed: Sep. 9, 1994

[51] Int. Cl.[6] ..... B24B 9/10

[52] U.S. Cl. ..... 451/5; 451/189; 451/241

[58] Field of Search ..... 451/44, 188, 189, 451/182, 241, 1, 5

[56] References Cited

U.S. PATENT DOCUMENTS

| | | | |
|---|---|---|---|
| 2,296,934 | 9/1942 | Kirkman et al. | 451/182 |
| 2,578,789 | 12/1951 | Donnelly | 451/260 |
| 2,826,872 | 3/1958 | Robbins | 451/44 |

FOREIGN PATENT DOCUMENTS

| | | | |
|---|---|---|---|
| 0126038 | 11/1984 | European Pat. Off. . | |
| 0365995 | 5/1990 | European Pat. Off. . | |
| 0165232 | 12/1985 | Germany | 451/44 |
| 0255476 | 2/1988 | Germany . | |
| 0206344 | 12/1967 | U.S.S.R. | 451/182 |

*Primary Examiner*—Robert A. Rose
*Attorney, Agent, or Firm*—Herbert Dubno

[57] ABSTRACT

An automatic machine for the production of rounded bevels at the corners of flat sheets, comprising a device (20) for the support and transfer of a sheet (3), hinged to fixed frame (10) of the machine and capable of rotating in relation thereto around an axial parallel to the feed direction, means (40) for stopping the feeding of such sheet, a means (30) holding sheet (3), hinged to fixed frame (10) and capable of rotating in relation thereto around an axis of rotation (32*a*) perpendicular to the plane of sheet (3), a work tool (50) integral with fixed frame (10) in relation to which it may be made to rotate via appropriate means (52, 52*a*), and means (60 ) for unloading sheet (3) on completion of the work, the axis of rotation of such means (30) for holding sheet (3) being capable of being moved in programmable settings with respect to a reference line parallel to lower edge (3*a*) of sheet (3) and the stopping surface of such means (40) for stoppage of movement being capable of being moved in programmable settings with respect to axis of rotation of the holding means so as to establish the desired radius of curvature.

6 Claims, 1 Drawing Sheet

AUTOMATIC MACHINE FOR THE PRODUCTION OF ROUNDED BEVELS AT THE CORNERS OF FLAT SHEETS

This invention relates to an automatic machine for production of rounded and/or substantially rectilinear bevels at the corners of flat sheets made of various materials.

BACKGROUND OF THE INVENTION

As is known, manufacture of flat sheets made of various materials often requires finishing of both the edges of the sheet and the corners thereof. In particular, it is necessary to carry out grinding of the edges and the removal of sharp corners which are primary areas of commencement of breakage of the sheet.

OBJECTS OF THE INVENTION

It is therefore the principle objects of the invention to provide a machine capable of taking a flat sheet, particularly a sheet of glass, and carrying out finishing of the sharp corners by rectilinear bevelling or by rounding. Still another object is to automatically carry out rounding and bevelling with different radii of curvature even on the same sheet without the need for complex machine tooling operations.

SUMMARY OF THE INVENTION

According to the present invention an automatic machine for the production of rounded and/or substantially rectilinear bevels at the corners of flat sheets, comprises a sheet supporting and transfer device hinged to the fixed frame of the machine and capable of rotating in relation thereto around an axis parallel to the direction of feed, means for stopping the feeding of such sheet, a sheet holding device hinged to the fixed frame and capable of rotating in relation thereto around an axis of rotation perpendicular to the plane of the sheet, a work tool and rotatable on the fixed frame for appropriate means for rotation, and a device for unloading the sheet upon completion of the work. The axis of rotation of such sheet holding device is displaceable in programmable setting with respect to a reference line parallel to the lower edge of the sheet and the stopping surface is capable of being moved in programmable settings with respect to the axis of rotation of the holding device so as to establish the desired radius of curvature.

BRIEF DESCRIPTION OF THE DRAWING

The above and other objects, features and advantages will become more readily apparent from the following description, reference being made to the following accompanying drawing.

SPECIFIC DESCRIPTION

Figure 1:
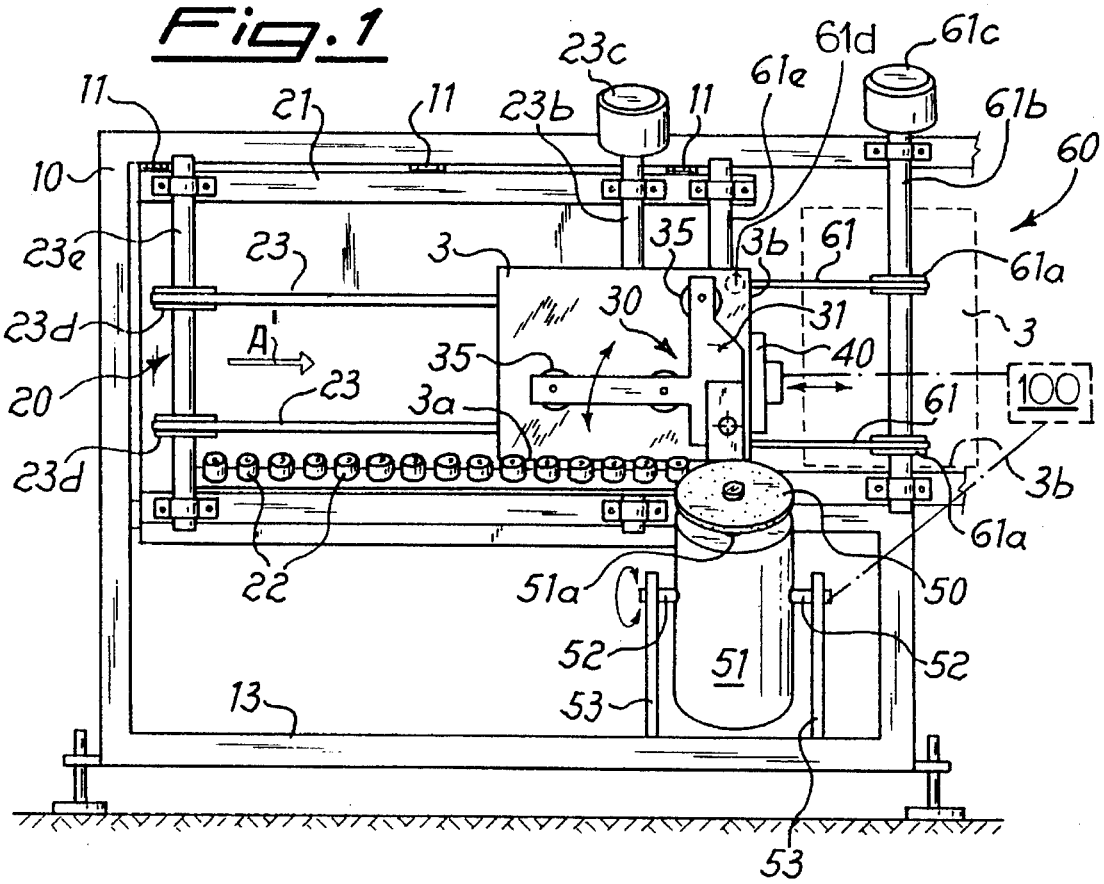
FIG. 1 is a front view of the machine according to the invention.

As illustrated in the figures, the machine according to the invention comprises a supporting frame 10 having a conveying device 20 mounted thereon. The device 20 is formed with a frame 21 which is hinged at the top to frame 10 by means of hinge 11 horizontal thereto and attached at its bottom to moving rods 2*a* of cylinders 2 linked to a crosspiece 12 of the frame 10, such structure maintains the entire conveying device 20 tilted back with respect to a front vertical plane of the machine and enables it to rotate around hinge 11 from a bottom position to a top position.

The lower end of the frame 21 is provided with idle rollers 22 arranged with their axis perpendicular to a plane A of the frame 21. The rollers 22 support a lower edge 3*a* of a sheet of glass 3 supported, in turn, on a pair of conveyor belts 23 which are located in a closed loop between drive rolls 23*a* and 23*d*. The rolls 23*a* are keyed to a shaft 23*b* rotatable by a motor 23*c*. The rolls 23*d* are mounted on an idle shaft 23*e*. In this manner glass sheet 3 is maintained tilted, being positioned while having its flat surface on conveyor belts 23 and the lower edge 3*a* on idle rollers 22, and may advance in a feed direction "A" carried by belts 23 and supported on idle rollers 22. As will become more clearly apparent from the following, such lower edge 3*a* of sheet 3, coinciding with an ideal tangent to roller 22, constitutes the zero reference line of the machine.

The entire conveying device is lowered with respect to a holding device 30 (described hereinafter) bringing about the transfer of sheet 3 up to a stop 40 formed on the conveying device 20. The stop may move in a direction parallel to the running direction and in both senses, in order to determine the stopping position of leading edge 3*b* of sheet 3 and consequently also, as will become more clearly apparent from the following, the radius of curvature of the final bevel.

At the zone of stoppage of sheet 3 and above the latter the machine is provided with the already mentioned device 30 for holding and handling the sheet. The holding device 30 includes a flat flange 31 integral with a support 32*b* keyed to shaft 32*a*, operated in rotation by a pneumatic rotating device 32 mounted on frame 10, in relation to which the entire holding device 30 may move via an actuator 34 in a direction transverse to feed direction A, in measurable movement relative to a fixed reference 33, thus bringing about the transfer of axis of rotation 32*a* from/to the zero line coinciding with lower edge 3*a* of sheet 3.

To the lower surface of flange 31 are furthermore applied stopping spacers 34 and suction pads 35 placed in a vacuum, using means which are known and therfore not illustrated.

Shaft 32*a* of rotating device 32 is substantially perpendicular to the plane of sheet 3 coinciding with the plane A of the frame 21, and the rotation of the shaft, controlled by device 32, brings about the controlled rotation of flange 31 and therefore of sheet 3 held thereon by suction pad 35. In the are of stoppage of sheet 3 is provided a cutting tool, for example, a grinding wheel 50 mounted on and rotatable with supporting flanges 53 integral with lower crosspiece 13 of frame 10. Motor 51 is rotatable around such pins 52 by a pneumatic cylinder 52*a* in order to bring about the rotation of motor 51 from a rest position, with wheel 50 clear of lower edge 3*a* of sheet 3, to a micrometrically adjustable working position with the spring adjoining such edge 3*a*.

Downstream of the sheet holding and handling device is provided an unloading device 60 (FIG. 1) removes the sheet 3 upon completion of the work and consisting of a pair of belts 61 arranged parallel to the direction of feed A1 and in a closed loop between drive rolls 61*a*, which are keyed to a shaft 61*b* perpendicular to the direction of feed and operated by a motor 61*c*, and rolls 61*d* keyed to an idle sheet 61*e*.

Figure 2:
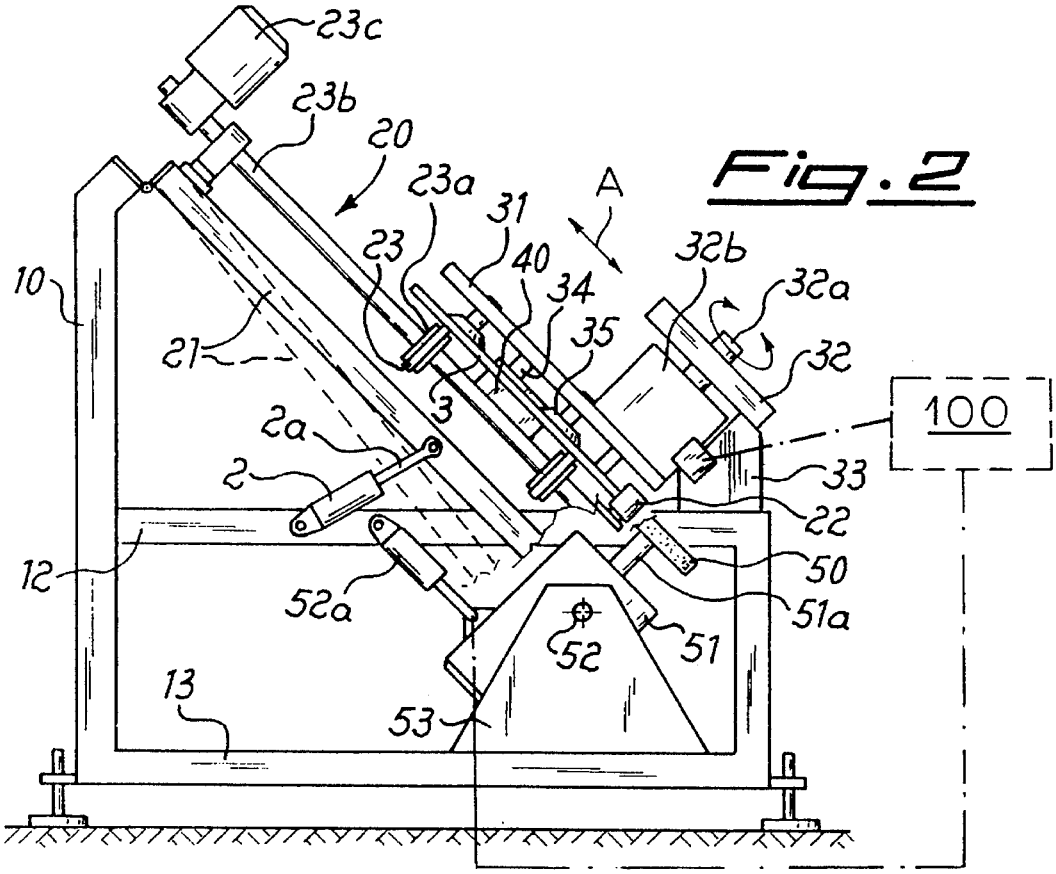
FIG. 2 is a side view of the machine shown in FIG. 1.

The operation of the machine is as follows: Initially, conveying device 20 is in the lower position (as shown in dotted outline in FIG. 2) and wheel 50 is in the rest position clear of the work line, substantially consisting of an ideal tangent to idle rollers 22, such tangent also substantially constituting the zero or reference line in relation to which is determined the setting of the various moving devices of the machine in order to obtain the desired radii of curvature of rounding. Once conveying device 20 has been started up, incoming sheet 3 is advanced as far as stop 40 which is preset to a predetermined distance from axis of rotation 32*a* of device 30 against which it stops. At this point cylinders 2 bring about the rotation of conveying device 20 around hinge 11 thus moving frame 21 to the raised position, and sheet 3 is correspondingly made to abut spacers 34, while suction pads 35, placed in a vacuum, move sheet 3 integral with holding device 30.

While the conveying device is lowered again to allow the feeding of a further sheet of glass, wheel 50 is maintained in rotation by motor 51 and swingable by pneumatic cylinder 52*a* to the working position, with the external profile resting on lower edge 3*a* of sheet 3 coinciding with the zero line. At this point, holding device 30 is made actuated by device 32, to bring about the movement of sheet 3 with respect to wheel 50 and therefore the execution of the desired rounding.

On completion of rotation, suction pads 35 release sheet 3, which falls onto unloading device 60 whereby it is removed from the machine for subsequent processing as appropriate.

It is clear that the radius of curvature of the rounding is determined by the dual regulation in a longitudinal sense (that is, parallel to the running direction) of item 40 , which stops leading edge 3*b* of sheet 3, and by regulation in a transverse sense relative to that of advance of the position of axis of rotation 32*a* of holding device 30 with respect to the fixed zero line which, as has already been stated, is represented by the tangent to rolls 22 on which rests lower edge 3*a* of sheet 3.

More particularly, the symmetrical regulation of such references will determine a position of the center of the radius of curvature lying on the bisectrix of the angle determined by lower edge 3*a* and leading edge 3*b*, with consequent symmetrical rounding. However, where the regulation of the two references is asymmetrical, the center of the radius of curvature would be outside such bisectrix, resulting in asymmetrical rounding.

It is also clear that by positioning center of rotation 32*a* of holding device 30 in the position furthest from the zero line in the transverse direction and simultaneously moving the profile of wheel 50 away from the said zero line by micrometric regulation of cylinder 52*a*, there is determined a radius of curvature such that rounding approximates a substantially rectilinear bevel. Control means regulating all actuator may be standard computer means 100 shown in FIG. 1 and FIG. 2.

Moreover, the position of the centre of rotation in the vicinity of the profile of the wheel makes it possible to obtain a highly accurate radius of curvature with the rectilinear edge of the sheet.

It is therefore clear that with the machine according to the invention produces rounding and bevels with a preset radius of curvature in an automatic manner and without limitations. It also produces rounding different radii of curvature even on the same sheet by simply adjusting the position of stop 40 and of the axis of shaft 32*a* which brings about the rotation of holding device 30, or to obtain rounding of equal radius on sheets 3 of different dimensions without the need for any setting of the position of the various devices of the machine.

Furthermore, by arranging in series four machines according to the invention it is possible to operate in a continuous cycle on the four corners of the sheet with equal or different rounding.

Many variants may be included in the implementation of the components of the invention without thereby departing from the scope of protection of this patent of invention as defined in the following claims. In particular, the pneumatic drives may be replaced by electric motors capable of being controlled by means of digital and like control devices.

I claim:

1. A device for machining corners of a flat sheet, comprising:

a stationary frame;

support means mounted swingable about a hinge axis on the stationary frame for guiding the flat sheet along a path lying in feed plane parallel to the hinge axis;

stop means displaceable along the path on the support means for stopping the flat sheet, determining thereby a stopping position of a leading edge of the flat sheet;

holding means mounted on the stationary frame and rotatable about a rotation axis extending transversely to the path for rotationally engaging the flat sheet in the stopping position of the leading edge of the flat sheet;

tool means swingable between rest and working positions about a swinging axis extending parallel to the hinge axis and mounted on the stationary frame along the path for shaping a corner of the leading edge in the stopping position of the latter and upon being swung in the working position, the tool means being rotatable about a tool axis extending perpendicular to the swinging axis and transversely to the path; and means for controllably positioning the stop, holding and tool means with respect to one another to machine a predetermined shape of the corner of the leading edge of the flat sheet.

2. The device defined in claim 1 wherein said support means includes a support frame provided with:

a plurality of hinges lying the in the same plane parallel to said feed plane and swingable about said hinge axis upon engaging said stationary frame, so that said support frame is swingable between a lower and upper position, and a plurality of idle rollers having mounted on said support frame and having parallel roller axes extending perpendicular to said feed plane for guiding a lower edge of the flat sheet along the path.

3. The support frame defined in claim 2 further comprising:

a plurality of supports mounted fixedly on said support frame in a support plane extending transversely to the feed plane and formed with respective drive and idle rollers keyed thereon, a plurality of closed loop belts wrapped about respective pairs of said drive and idle rollers for conveying the flat sheet along the path.

4. The device defined in claim 1 further comprising support actuator means mounted on said stationary frame for providing the swinging of the support means.

5. The device defined in claim 1 wherein said holding means includes a shaft rotatable about said rotation axis, a bottom flat flange mounted on a lower end of said shaft and extending in a respective plane lying perpendicular to said rotation axis, a plurality of stoppers mounted on said flat flange an engaging the flat sheet for further rotation thereof, and shaft actuator means juxtaposed between said stationary and support frames for actuating said shaft and operatively connected with said control means.

6. The device defined in claim 1 wherein said tool means includes:

a motor provided with a motor shaft rotatable about said tool axis, a wheel mounted on said motor shaft, and shaft actuator means for swinging said motor between said working and rest positions of said tool means and operatively connected with said control means.

* * * * *